United States Patent [19]

Stone

[11] 4,435,937

[45] Mar. 13, 1984

[54] CONCEALED FASTENER SUPPORT FOR INTERLOCKED CHANNEL SECTION PANELS

[75] Inventor: Lester W. Stone, Germantown, Ohio

[73] Assignee: Armco Inc., Middletown, Ohio

[21] Appl. No.: 356,126

[22] Filed: Mar. 8, 1982

[51] Int. Cl.[3] ..... E04D 3/24; E04D 3/36

[52] U.S. Cl. ..... 52/520; 52/544

[58] Field of Search ..... 52/478, 520, 544, 528, 52/483, 512, 551

[56] References Cited

U.S. PATENT DOCUMENTS

| | | | |
|---|---|---|---|
| 3,909,998 | 10/1975 | Simpson et al. | 52/520 |
| 4,058,949 | 11/1977 | Bellem | 52/478 |
| 4,102,105 | 7/1978 | Taylor et al. | 52/520 |
| 4,114,338 | 9/1978 | Beck | 52/478 |
| 4,348,846 | 9/1982 | Bellem | 52/410 |

*Primary Examiner*—James L. Ridgill, Jr.

*Attorney, Agent, or Firm*—Frost & Jacobs

[57] ABSTRACT

An integral, one-piece bearing support to support a concealed fastener for anchoring pairs of rigid interlocked metal panels to spaced supporting members. The bearing support comprises a pair of coplanar portions and an intermediate lower planar portion or depressed portion lying below that of the coplanar portions, with the coplanar portions and the intermediate portion being joined by downwardly portions at lapped panels, the bearing support includes a plurality of coplanar portions, adjacent pairs of which are joined together by depressed lower portions and the downward portions.

11 Claims, 7 Drawing Figures

CONCEALED FASTENER SUPPORT FOR INTERLOCKED CHANNEL SECTION PANELS

BACKGROUND OF THE INVENTION

1. Field of the Invention

This invention relates to a roof structure of the type using a plurality of roofing panels, adjacent margins of which are form-coupled to provide a functionally continuous roof, and more particularly to such a roof structure which incorporates rigid board insulation.

2. Description of the Prior Art

Typical pre-engineered metal building roof structures such as the structure disclosed in U.S. Pat. No. 4,102,105, include a plurality of spaced purlins and a series of pairs of relatively stiff and rigid interlocked roof panels enclosing the space between the spaced purlins. Concealed fasteners are generally utilized to secure the pairs of roof panels to the underlying purlins. The panels are almost always lapped and sealed, depending upon the length of the roof and the panel length. Typically, the entire roof system generally utilizes a single layer blanket thermal insulation, such as flexible glass fiber blankets, laid end-to-end and stretched over the spaced purlins. This insulation is installed just prior to insulation of the roof panels.

The insulation is pinched or compressed at each purlin location when the roof panels are fastened to the purlins. The compressed or distorted insulation forms a "thermal weakness" or heat path having low thermal resistance. Accordingly, much heat loss can occur through the insulated roof at and near each purlin location. When it is considered that purlins are spaced generally at five foot intervals and that the width of a purlin flange is three inches, it will readily be seen that there is a substantial heat loss.

Aside from the "thermal weakness" areas near purlins, blanket type insulation is inadequate for many building thermal requirements. Using increased thickness or multiple layers of thicknesses are frequently still inadequate and inefficient.

The prior art has sought to minimize the heat loss by utilizing "thermal spacers" at purlins. A further solution for overcoming thermal inefficiency is proposed in U.S. Pat. No. 4,058,949. This patent suggests using a plurality of layers of flexible insulation. The layers of insulation are separated by U-shaped channel members at the purlin location. However, this has not proven to be a satisfactory solution to the problem. The insulation is still pinched or distorted between the roofing panels, U-shaped member, and purlins. The same "thermal weakness", although possibly to a lesser degree, still exists. Even without the distorted insulation, blanket insulation is inefficient. It has been determined more than six inches of blanket insulation is required to equal the thermal efficiency of three inches of rigid board insulation. But, only about four inches maximum blanket insulation is thermally efficient.

Accordingly, there is a real need to develop better insulation systems. Most present roof systems use concealed fasteners. Rigid board insulation does not readily accommodate concealed fasteners.

SUMMARY OF THE INVENTION

The present invention provides an integral, one-piece bearing support for supporting a concealed fastener of the type having a foot extending from the lower end thereof for anchoring pairs of rigid interlocked metal panels to spaced supporting members. The bearing support comprises a pair of upper coplanar portions and an intermediate lower planar portion lying below that of the coplanar portions, with the coplanar portions and the intermediate portion joined by downwardly portions, which may be vertical but preferably slope toward each other, forming a recess in which the foot of the concealed fastener is received. When the bearing support is installed, the recess is pulled into the rigid board insulation between the metal panels and the spaced supporting members by an amount substantially equal to the depth of the recess and such that the pair of planar portions are substantially coplanar with the upper surface of the rigid board insulation.

In a preferred embodiment, the upper portions of the bearing support are of the same width. Additionally, the free edge of an upper portion of the bearing support may be provided with a downwardly depending flange. The intermediate lower planar portion of the bearing support is preferably provided with a central perforation for receipt of a through-fastener.

In practice a typical metal building roof structure includes panels which are almost always lapped and sealed, depending upon the length of the roof and the panel length. The present invention provides a further embodiment of the bearing support for use at lapped panel joints. This bearing support overlies the rigid thermal board insulation sandwiched between each of the spaced purlins and the panels at the lapped joints. This embodiment of the bearing support of the present invention comprises a plurality of upper coplanar portions and a lower portion between adjacent pairs of the upper portions and joined thereto by portions which extend downwardly with the lower portions being coplanar and lying in a plane parallel to the plane of the upper portions. Although the downwardly portions may be vertical, it is preferred that they slope toward each other. The upper portions may be of the same width. Each of the lower portions is preferrably provided with an elongated slot extending longitudinally thereof for receipt of a through-fastener.

The embodiment of the bearing support of the present invention for use at lapped joints reinforces lapped joints to prevent separation of the sealant, keeps the lapped joints tight under intermittent loading, and permits movement of panels independent of the spaced supporting members.

The bearing supports of the present invention allow the use of rigid board insulation and concealed fasteners in roof structures of the type using a plurality of roofing panels having adjacent margins which are form coupled together. Using rigid board insulation rather than blanket insulation results in greater rigidity to the roofing structure and provides much more thermal efficiency.

DESCRIPTION OF THE PREFERRED EMBODIMENTS

Figure 1:
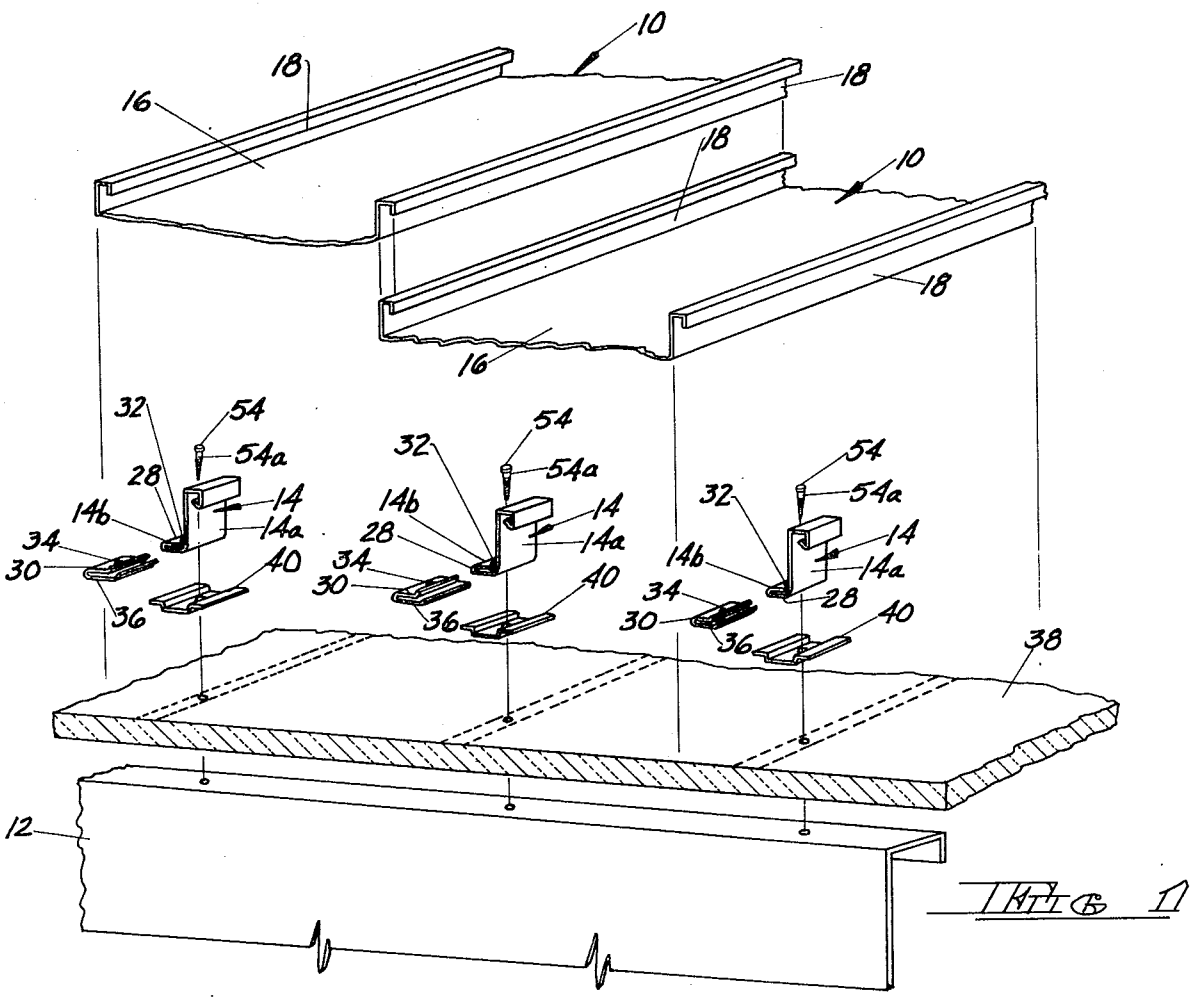
FIG. 1 is an exploded, perspective view of an exemplary roof structure which utilizes the bearing support of the present invention.

Referring now to the drawings, and in particular to FIG. 1, it will be seen that a typical building structure incorporating the present invention may include a series of pairs of relatively stiff and rigid interlocked metal panels 10 having adjacent margins which are form coupled and being of self-supporting capacity affixed to and closing the space between spaced supporting members, such as, for example, the purlin 12, which may be a z-purlin, c-purlin, v-truss, bar joist, or the like, and concealed clip connectors 14, which are of a relatively shorter length than the coupled panels 10 and anchor the coupled panels 10 to the purlins 12.

It will, of course, be understood that clip connectors 14 and panels 10 described herein in connection with the present invention are exemplary of a variety of concealed fasteners and edge coupled panels for which the present invention may be used. For example, any panels having upstanding coupled edges capable of including concealed fasteners may be used with the present invention.

Each of the panels 10 may be provided with a central web surface 16 annd a pair of sidewalls 18 projecting outwardly from opposing edges of the web 16 to form upstanding ribs along the abutting edges of the panels 10 adapted to form rib joints 20. Each rib joint 20 has a female member 22 secured along the edge of one panel 10 and a corresponding male member 24 secured along the edge of the adjacent panel 10. The male and female members 24 and 22, respectively, have corresponding upstanding members **24*a* and 22*a* projecting from the abutting edges, corresponding upper portions 24*b* and 22*b*, and deformable flange hook portions 24*c* and 22*c* extending downwardly from the upper portions 24*b* and 22*b*, respectively, toward but not contacting, the web surface 16 of the panels 10**.

Figures 1, 2, 3, 4:
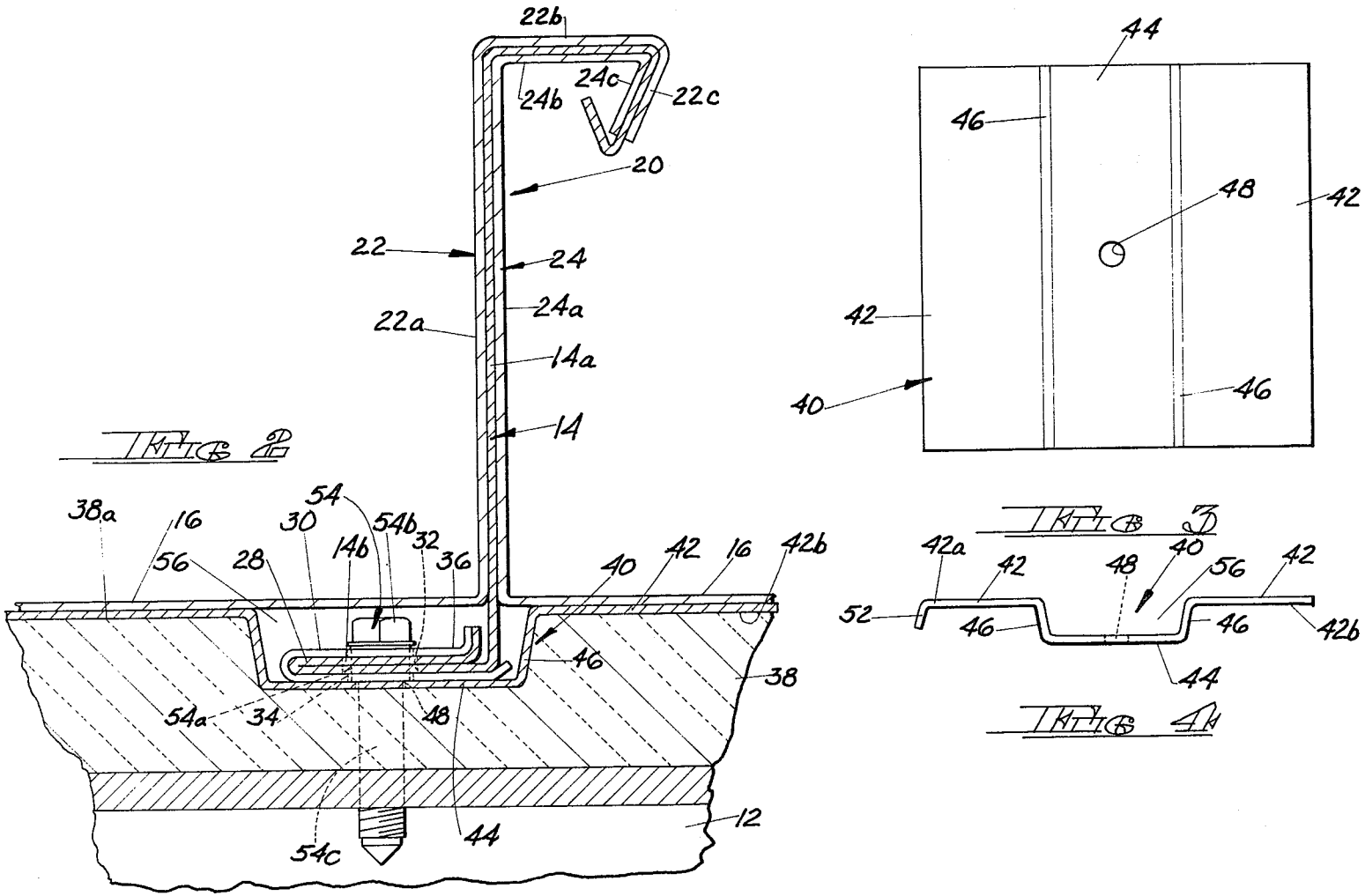
FIG. 2 is a cross-sectional view through the bearing support shown in FIG. 1 when the roof panels are assembled.
FIG. 3 is a plan view of the bearing support of the present invention.
FIG. 4 is an elevational view of the bearing support showing an alternative embodiment wherein the free edge of one of the upper portions is provided with a downwardly depending flange.

Exemplary clip connectors 14, for securing the panels 10 to the purlins 12, are best seen in FIGS. 1 and 2. As can be seen, the clip connector 14 comprises a body portion **14*a* which is configured such that it conforms to the outside surface of the upstanding member 24*a*, upper portion 24*b* and hook flange portion 24*c* of the male member 24. The foot 14*b* of the clip connector 14 is formed from the bottom of the body portion 14*a* and comprises a return bent flange 28 having an elongated slot 32 formed therein extending longitudinally thereof. A washer member 30 is located on the return bent flange 28 and preferably comprises a U-shaped member which is snugly received on the return bent portion 28. An aperture 34 is provided through the legs of the U-shaped member 30 in alignment with the elongated slot 32**.

Suitable rigid board insulation 38 is installed in the normal fashion over the supporting members or purlins 12. Rigid board insulation 38 is preferable to blanket or roll insulation because blanket or roll insulation is squeezed flat at purlins 12, greatly reducing the thermal efficiency. The importance of this problem is readily seen when it is considered that purlins 12, with a flange width of 3 inches, are spaced at 5 foot intervals.

The present invention allows the use of a roof structure comprising the panels 10 and concealed fasteners 14 with rigid board insulation 38. This is accomplished because of the use of the bearing supports 40 with each of the concealed clip connectors 14. Each bearing support 40 comprises a pair of upper coplanar portions 42 and an intermediate lower planar portion 44 lying below the plane of the coplanar portions 42. The coplanar portions 42 and the intermediate portion 44 are joined by downwardly extending portions 46 which may be vertical but preferably slope toward each other. Preferably the width of the coplanar upper portions 42 is the same. In practice the lower portion 44 is preferably provided with a central perforation 48.

In a preferred embodiment the free edge **42*a* of one of the upper portions 42 is provided with a downwardly depending flange 52, which cuts into the rigid board insulation 38 during installation and helps prevent rotation of the bearing support 40 when it is tightened to the purlins 12**.

During installation, the concealed fastener 14 is connected to a purlin 12 by a suitable fastener means such as the preferred self-drilling fastener 54 through the aperture 34 of the U-shaped washer 30 and the elongated slot 32 in the foot **14*b* of the clip 14, into the aperture 48 on the intermediate portion 44 of the bearing support 40, through the rigid board insulation 38, and finally into the purlin 12. The roof is laid by placing rigid board insulation 38 over installed purlins 12, placement of a male-flanged panel 10, installation of the concealed fastener clip 14 and bearing support 40, installation of the female-flanged panel 10, and crimping of the panels 10**, as is well known in the art.

As can best be seen in FIG. 2, the preferred fastener 54 is provided with a shoulder **54*a* between the head 54*b* and the shank 54*c*. The diameter of the perforation 48 is less than that of the aperture 34 of the washer 30 or the transverse width of the slot 32 in the foot 14*b*. The diameter of the shoulder 54*a* of the fastener 54 is such as to allow it to pass through the aperture 34 or the slot 32 but not the perforation 48. The length of the shoulder 54*a* is slightly greater than the combined thicknesses of the foot 14*b* and the washer 30. Thus, the bottom of the shoulder 54*a* abuts the top surface of the bearing support 40 and the bottom of the fastener head 54*b* does not contact the upper surface of the washer 30**.

When the fastener 54 is anchored to the purlin 12, the recess 56 of the bearing support 40 is tightly pulled into the insulation 38. However, the clip 14 is not pinched tightly into contact with the upper surface of the bearing support 40 because of the shoulder offset. If thermal expansion occurs, the foot **14*b* can easily move relative to the washer 30. Without the offset, this movement would be difficult because the foot 14*b* and the washer 30 would be held tight against the bearing support 40**.

It will be understood that when thermal expansion occurs the bearing support 40, which holds the fastener 54 as it passes through the aperture 48 into the purlin 12, provides sufficient resistance to movement, with the thermal expansion force being compensated for by slippage between the concealed fasteners 14 and their associated washer member 30.

The desired thickness of the rigid board insulation 38 required for a specific installation is specified to the supplier. Even so, the thickness can vary substantially. The through-fasteners 54 as used in the present invention are a sufficient length to accommodate variable rigid board insulation thickness during installation.

It should be noted that when the bearing supports 40 of the present invention are installed, the recess 56 formed by the upper coplanar portions 42, the lower intermediate portion 44 and the downwardly portions 46, is pulled into the rigid board insulation 38 by an amount about equal to the depth of the recess 56. This assures that the underside **42*b* of each upper coplanar portion 42 is contiguous with the upper surface 38*a* of the rigid board insulation 38. There are two reasons for this. One is so the head of the fastener 54 will be below the bottom surface of the roofing panels 10. This is important because foot traffic would cause the fasteners 54 to make holes or dents in the panels 10. Second, when thermal expansion occurs, the bearing support 40 resists moving with the concealed fastener 14. This allows the concealed fastener 14, which, as hereinbefore described, is provided with an elongated slot 32 in its foot 14*b*, and roofing panels 10 to move and be independent of the bearing supports 40. This is important, because if the bearing supports 40 tended to move, the fasteners 54 would tear or even pull from the purlin 12**.

Figure 5:
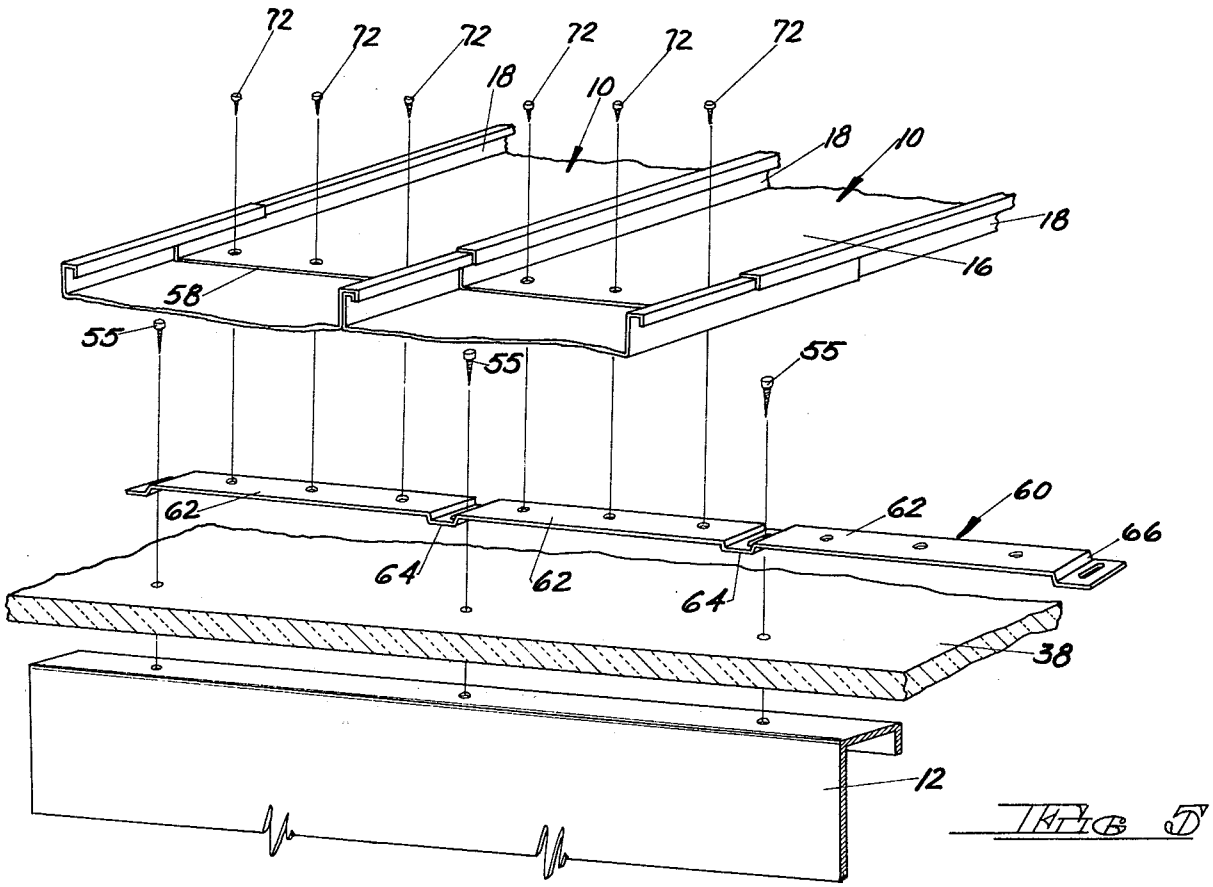
FIG. 5 is an exploded, perspective view of an exemplary roof structure similar to FIG. 1 but at a location where the panels are lapped, showing a further embodiment of the bearing support of the present invention.
Figures 6, 7:
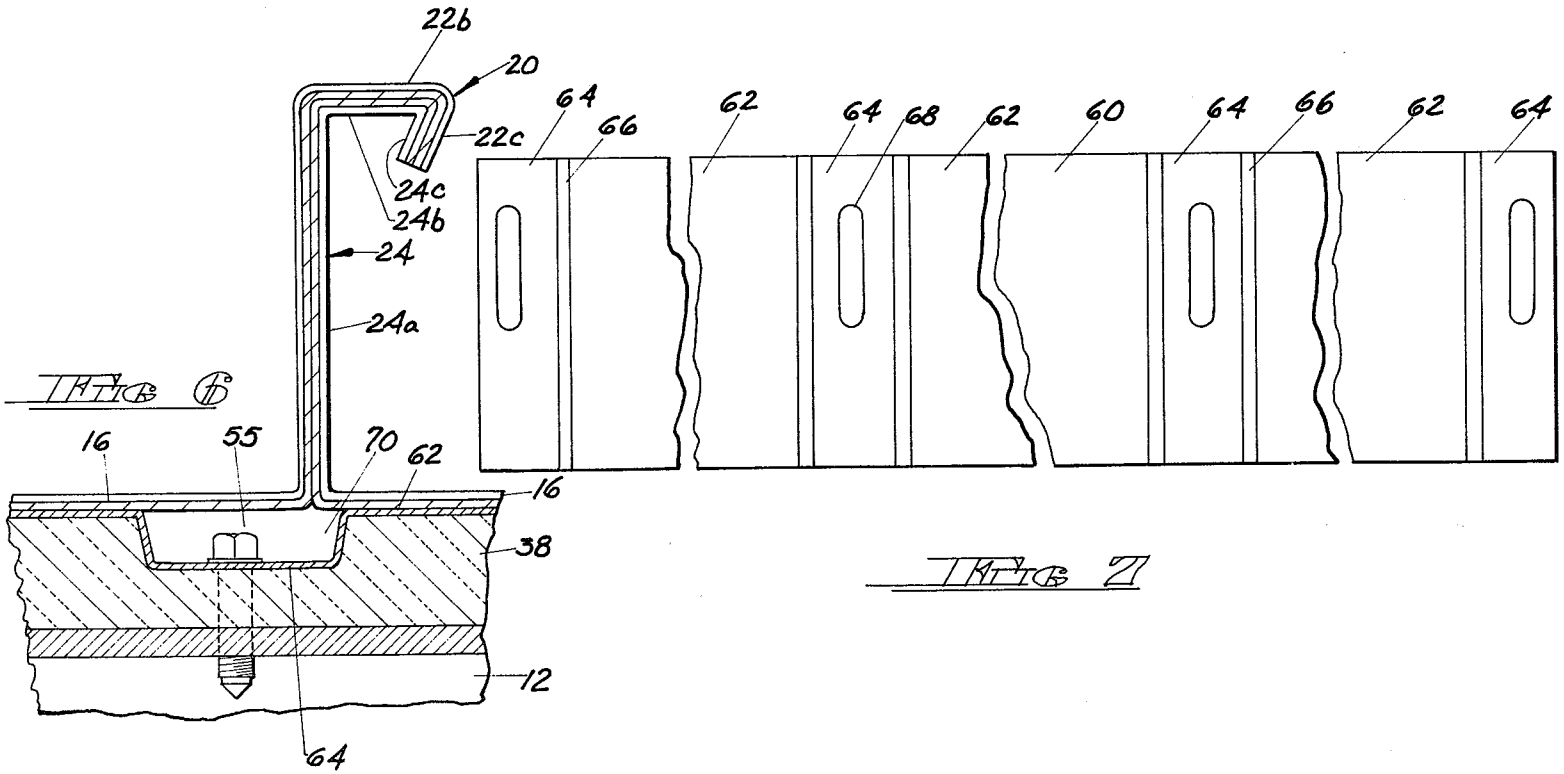
FIG. 6 is a cross-sectional view through the embodiment of the bearing support shown in FIG. 5 when the roof panels are assembled.
FIG. 7 is a plan view of the embodiment of the bearing support shown in FIGS. 5 and 6.

If a building width is such as to require a roof slope longer than the length of one panel 10, more than one panel 10 is required. At each panel overlap 58, such as shown in FIG. 5, a lapped or swaged joint must be used. While embodiment of the bearing support plate 60 shown in FIGS. 5, 6 and 7 may be utilized with concealed fasteners 14 to secure the panels 10 to the purlins 12 at lapped joints 58, normally concealed fasteners 14 will not be used since through-fasteners 72 are utilized.

The bearing support 60 comprises a plurality of upper coplanar portions 62 and a lower portion 64 between adjacent pairs of the upper portions 62 and joined thereto by portions 66 which extend downwardly. The lower portions 64 are coplanar and lie in a plane parallel to the plane of the upper portions 62. Each lower portion 64 is preferably provided with an elongated slot 68 extending longitudinally of the lower portion 64 for receipt of fastener means 55 comprising any well known self-drilling fastener. However, if for some reason it is desired to utilize concealed fasteners 14 with the bearing support 60, a central perforation should be substituted for each elongated slot 68 and the fastener means 54 should preferrably be used. It will, of course, be understood that the adjacent pairs of upper portions 62 and the intermediate lower portion 64 form recesses 70 which may be located as desired along the length of the bearing support 60. However, in a preferred embodiment the upper portions 62 are of the same width. Similarly, the lower portions 64 are also of the same width.

The bearing support 60 functions in substantially the same way as the bearing support 40. Through fasteners 72 secure the swage joint 58 directly to the bearing support 60. The bearing support 60 is secured to purlins 12 by passing through-fasteners 55 into the elongated slot 68 of the bearing support 60, into the rigid board insulation 38 and into the purlin 12. During the installation the recesses 70 of the bearing support 60 are pulled into the rigid board insulation 38 by an amount about equal to the depth of each recess 70, resulting in the upper coplanar portions 62 being coplanar with the upper surface of the rigid board insulation 38. As was previously explained, this allows the head of the through-fastener 55 to be below the bottom surface of the panels 10, precluding foot traffic from causing the through-fastener 55 to make holes or dents in the panels 10. In practice, when thermal expansion occurs the force is compensated for by the slippage between the bearing support 60 and its associated purlin 12, as the bearing support 60 cuts a path through the insulation 38. The elongated slots 68 allow the bearing support 60 to move independent of the fasteners 55.

As noted above, the perforation in the lower portion 64 of bearing support 60 is preferably slotted. Since through-fasteners 72 normally connect the roofing panels 10 to the bearing support 60, concealed fasteners 14 normally are not used at the swage joints. When thermal expansion occurs, and unlike the situation with bearing supports 40 where the force is accommodated by concealed fasteners 14, the force of movement is accommodated by the support 60. Although pulling of lower portion 64 into the rigid insulation 38 resists movement, this resistance will be overcome if sufficient expansion force exists.

It should be pointed out that some additional optional features or advantages of the bearing supports of the present invention are apparent. The bearing supports 40 and 60 of the present invention allow the use of rigid board insulation 38 rather than blanket insulation. This results in greater rigidity to the roofing structure and improved thermal efficiency. Additionally, more rigidity is obtained in roofing systems which utilize rigid board insulation 38 and the bearing supports 40 and 60 of the present invention when using 24 gauge panels 10 than prior art roofing systems which incorporate only blanket or roll insulation when using 22 gauge roofing panels 10. It will, of course, be obvious that variable thicknesses of rigid board insulation 38 can easily be accommodated by roofing systems using the bearing supports 40 and 60 of the present invention by using different length through-fasteners 54.

It will be understood that changes in the details, materials, steps and arrangement of parts, which have been hereindescribed and illustrated in order to explain the nature of the invention, may be made by those skilled in the art within the principle and scope of the invention as expressed in the appended claims.

What is claimed is:

1. In a roof structure, a series of interlocked roof panels having adjacent margins forming rib joints and being of self-supporting capacity and closing the space between said purlins, rigid insulation sandwiched between said panels and said purlins, an integral, one-piece bearing support member overlying said rigid insulation of each said rib joint, said bearing support member comprising a pair of upper coplanar portions and an intermediate lower planar portion lying in a plane parallel to that of said coplanar portions, said coplanar portions and said intermediate lower portion being joined by a pair of downwardly extending portions to form a recess extending fully between opposite edges of said bearing support, said panels being connected to said bearing support, and a concealed fastener and associated through fastener means positioned along said rib joint in said recess to anchor said bearing support member to said purlin, each said concealed fastener having a foot extending from the lower end thereof for anchoring pairs of rigid interlocked metal panels at said rib joints, the foot of each said concealed fastener being contiguous with said lower portion, said recess of said bearing support member being tightly pulled into said rigid insulation an amount about equal to the depth of said recess such that the lower surfaces of said coplanar portions are substantially contiguous with the upper surface of said rigid insulation.

2. The roof structure according to claim 1, wherein said upper portions are of the same width.

3. The structure according to claim 1, wherein the free edge of one of said upper portions is provided with a downwardly depending flange.

4. The structure according to claim 1, wherein said downwardly portions slope toward each other.

5. The bearing support according to claim 1, wherein said lower portion is provided with a central perforation therein.

6. The structure according to claim 5, wherein said foot comprises a return bent flange having an elongated slot formed therein extending longitudinally thereof, a washer member located on said return bent flange, said washer member comprising a U-shaped member which is snuggly received on and said return bent portion, and an aperture through the legs of said U-shaped member in alignment with said elongated slot in said return bent flange, said associated through-fastener extending through said aperture, said elongated slot, and said perforation into said purlin.

7. The structure according to claim 6, wherein each said through fastener comprises a self-drilling screw having a shoulder between the head and shank thereof, the diameter of said central perforation in said bearing support member being less than that of said aperture in said washer member and the transverse width of said slot in said foot but such as to allow said shoulder to pass through said aperture in the legs of said U-shaped member and said slot in said return bent flange but not the aperture in said bearing support member, and the length of said shoulder being slightly greater than the combined thicknesses of said foot and said washer member, whereby when said fastener is anchored to said purlin the bottom of said shoulder abuts the top surface of said bearing support and the bottom of said fastener head is precluded from contacting the upper surface of said washer member when the recess of said bearing support is tightly pulled into said insulation but said concealed fastener is precluded from being pinched tightly into contact with the upper surface of said bearing support.

8. The structure according to claim 1, including a plurality of coplanar portions adjacent pairs of which are joined together by said lower portions and said downwardly portions.

9. The structure according to claim 8 wherein said upper portions are the same width.

10. The structure according to claim 8 wherein said lower portions are the same width.

11. The structure according to claim 8, wherein each said lower portion is provided with an elongated slot formed therein extending longitudinally thereof and being substantially parallel to said upper portions.

* * * * *